United States Patent [19]

Hargassner et al.

[11] 4,210,197

[45] Jul. 1, 1980

[54] LIFTING-TABLE-GUIDE ARRANGEMENT

[75] Inventors: Reinhard Hargassner; Günter Holleis; Rudolf Hoscher, all of Linz, Austria

[73] Assignee: Voest-Alpine Aktiengesellschaft, Linz, Austria

[21] Appl. No.: 18,771

[22] Filed: Mar. 8, 1979

[30] Foreign Application Priority Data

Mar. 14, 1978 [AT] Austria ..... 1805/78

[51] Int. Cl.[2] ..... B22D 11/04

[52] U.S. Cl. ..... 164/416

[58] Field of Search ..... 164/83, 416

[56] References Cited

U.S. PATENT DOCUMENTS

| | | | |
|---|---|---|---|
| 3,612,156 | 10/1971 | Schoffmann | 164/416 |
| 3,662,813 | 5/1972 | Stull | 164/416 X |
| 3,779,303 | 12/1973 | Pietryka | 164/416 |

FOREIGN PATENT DOCUMENTS

| | | |
|---|---|---|
| 301781 | 9/1972 | Austria . |
| 336826 | 5/1977 | Austria . |
| 2008080 | 1/1972 | Fed. Rep. of Germany . |

*Primary Examiner*—Robert D. Baldwin

*Attorney, Agent, or Firm*—Brumbaugh, Graves, Donohue & Raymond

[57] ABSTRACT

In a lifting-table-guide arrangement having two oppositely arranged vertical guide elements provided on each of two opposing sides of a mould lifting-table of a continuous casting plant, one of the two oppositely arranged vertical guide elements provided on each of two opposing sides is supported by two rollers mounted one above the other in a lifting-table-guide stand and the other one of the two oppositely arranged vertical guide elements provided on each of two opposing sides is supported by a single counter bearing. The counter bearing is designed as a bearing for a rocker having two rollers arranged at a distance from each other, which rollers support the other one of the two oppositely arranged vertical guide elements.

4 Claims, 4 Drawing Figures

LIFTING-TABLE-GUIDE ARRANGEMENT

BACKGROUND OF THE INVENTION

The invention relates to a lifting-table guide having two oppositely arranged vertical guide elements at opposing sides of a mould lifting-table of a continuous casting plant, one guide element each of the oppositely arranged guide elements being supported by two rollers mounted one above the other in a stand of the lifting-table guide and the guide element oppositely arranged each being supported by a single counter bearing.

High demands are made on the guide for a lifting-table, since a slight change of position of the mould fastened to the lifting-table relative to the following strand guide will lead to difficulties during casting, due to the formation of cracks at the strand. When the oscillating movement of the mould is interrupted, the danger of a strand break-through exists, so that the plant will have to be stopped. For this reason, jamming of the lifting-table guide is to be reliably avoided.

With a lifting-table guide known from U.S. Pat. No. 3,612,156, the guide elements arranged in pairs on each side of the lifting table, are each laterally supported by means of four rollers mounted on a stationary supporting construction, two rollers each being arranged oppositely in pairs, so that the guide elements on one side of the lifting-table are supported by a lower and an upper pair of rollers. The position of the axes of these rollers is adjustable and fixable by means of an eccentric, for the purpose of adaptation to the guide elements and exact adjustment of the mould.

By this construction a very precise guiding of the lifting table and thus the mould is possible, since that guide has the advantage that two opposingly arranged guide rollers always contact the guide ledges with approximately equal Hertz pressure. There may however occur difficulties when adjusting the rollers. In particular, it is difficult for the operating personnel to adjust each of the two roller pairs to the guide elements with the same adjustment force.

By this it may happen that, for instance, the guide elements on one side of the lifting-table are guided between one pair of rollers by high pressure forces and between the other pair of rollers only by slight pressure forces, which will result in an uneven wear of the guide elements.

From German Offenlegungsschrift No. 2,008,080 a lifting-table guide of the initially-described kind is known in which one guide element each, of the oppositely arranged guide elements, is supported by two rollers arranged one above the other, and each guide element arranged oppositely therefrom is supported by a single roller, the single roller being at a height between the height of the two rollers arranged one above the other, so that a three-point support is reached. This known construction has the advantage that an approximately even wear of the guide elements is achieved, but it has the disadvantage that the rollers are strained by differing forces, since the two rollers arranged one above the other contact the corresponding guide element only with half of the force of the oppositely arranged guide roller, whereby the Hertz pressure occurring at the rollers is of different extents. This necessitates unequal dimensioning of the rollers.

SUMMARY OF THE INVENTION

The invention has as its object to prevent the disadvantages inherent in the two known lifting-table guide constructions and to provide a lifting-table guide combining in it the advantages of the two known constructions. On the one hand, a three-point-support, and on the other hand, a mounting by means of four equally strained rollers is to be realized. Thus an even wear of each guide element is ensured and the adjustment of the rollers can be carried out in a simple way, so that operational disturbances caused by adjustment errors are avoided.

This object is achieved according to the invention in that the counter bearing is designed as a bearing for a rocker (cartwright beam) having two rollers arranged at a distance from each other and supporting the guide element.

According to a preferred embodiment, the counter bearing is arranged at a lever that is pivotable and fixable about a stationary pivot axis, the lever being displaceable by means of a displacement mmechanism which is linked, on the one hand, to the lever at a distance from the bearing of the rocker and, on the other hand, to the lifting-table-guide stand, preferably by means of a turnbuckle or a hydraulic gear.

BRIEF DESCRIPTION OF THE DRAWINGS

The invention will now be explained in more detail by way of two embodiments illustrated in the accompanying drawings, wherein.

DESCRIPTION OF PREFERRED EMBODIMENTS

Figure 1:
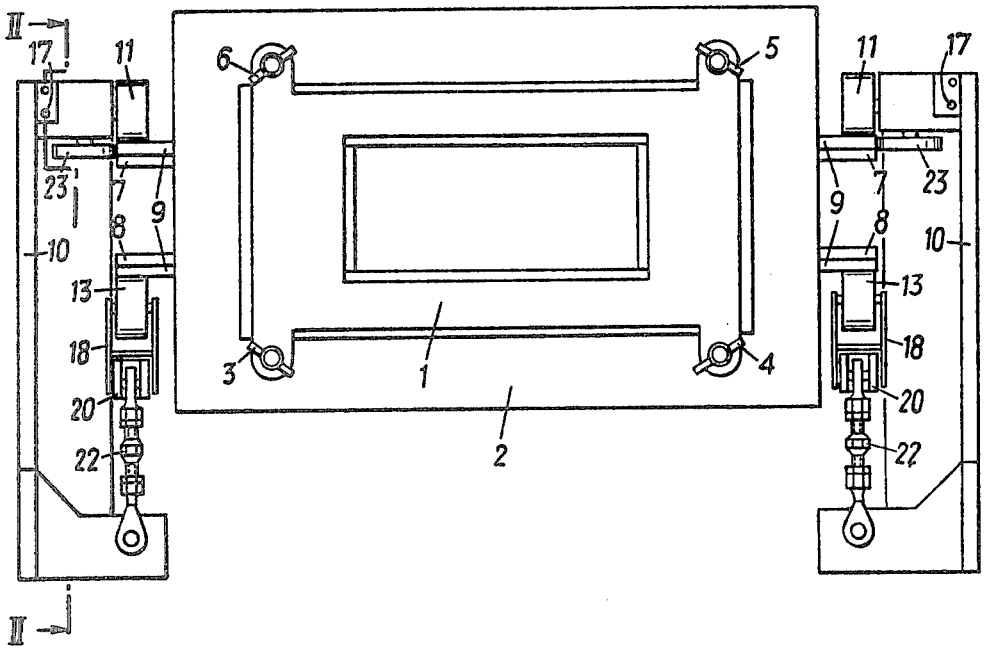
FIG. 1 is a ground plan of the lifting-table.
Figure 2:
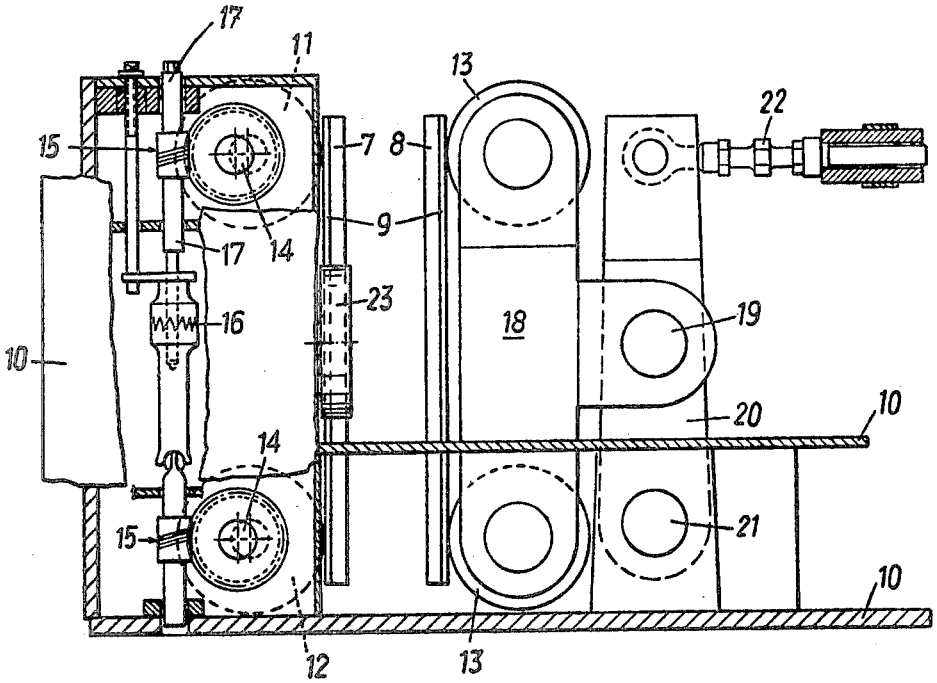
FIG. 2 is a section along line II—II of FIG. 1.

A continuous mould 1 provided for the casting of a slab is detachably fastened by means of easily detachable wedge connections 3, 4, 5 and 6, to a lifting-table 2 that is designed as a rectangular, closed frame. On the narrow sides of the lifting table 2 two vertically extending guide elements 7 and 8 are each provided, on each of which a wear ledge 9 is mounted. Moreover, levers of an oscillating device (not illustrated) engage at the narrow sides of the lifting-table, causing the lifting-table to vertically oscillate, while keeping the lifting-table in a horizontal position over its longitudinal extension.

The lateral fixation of the lifting-table in the horizontal direction parallel to the narrow sides of the lifting-table is effected by means of rollers 11, 12 and 13 mounted on a stationary lifting-table-guide stand 10 and coacting with the guide elements 7, 8 and whose axes are directed at right angles relative to the narrow sides of the lifting-table.

The rollers 11 and 12 are arranged vertically one above the other and contact the wear ledges 9. The position of their axes can be adjusted by means of eccentrics 14. Worm gears 15 serve for turning the eccentrics 14 and are connected to one another by means of a connecting shaft 17 that is separable by a coupling 16, whereby it is possible to adjust the roller 11 either alone or together with the roller 12. The rollers 13 are rotatably mounted in a rocker 18 and rest on the wear ledges 9 that are mounted on the guide element 8. The rocker 18 is pivotally mounted with a bearing 19 on a lever 20, the bearing 19 being at a level of height between that of the two rollers 11, 12 mounted one above the other in the lifting-table-guide stand 10. In this way, the lifting table is three-point-mounted on each narrow side in the horizontal direction and in a direction parallel to the narrow sides. One end of lever 20 is pivotable about a stationary pivot axis 21 which is also fastened to the lifting-table-guide stand 10. A turnbuckle 22 is hinged, on the one hand, to the other end of the lever 20 at a distance from the bearing 19 and, on the other hand, to the lifting-table-guide stand 10.

For supporting the lifting table 2 in a horizontal direction at a right angle to the narrow sides of the lifting-table, rollers 23 which are rotatably mounted in the lifting-table-guide stand 10 and contact the guide elements 7 are provided.

Adjustment of the rollers 11 to 13 is effected in the following way:

At first, the rollers 11, 12 are brought into a precisely vertical position by means of the worm gears 15, the position of the mould 1 towards the following strand guide being taken into consideration so that no misalignment will occur between the mould and the strand guide. The worm gears 15 are self-lockingly designed, so that the position of the rollers 11, 12 is fixed when the worm gears 15 are not operating. Afterwards, the lever 20 is moved, by means of the turnbuckle 22, about the pivot axis 21 in the direction toward the guide element 8, until the rollers 13 contact the wear ledge 9 of this guide element 8. The contact can be checked in a simple way during that procedure by trying to turn the upper one of the two rollers 13, which roller is more easily accessible than the lower roller 13. Once this roller cannot be turned any more, a snug contact of the two rollers 13 on the wear ledge 9 is ensured, since, through the pivotally movable mounting of the rocker 18 within the bearing 19, an equalization of force always takes place. The bearing 19 thus constitutes the counter bearing proper on which the guide element 8 is supported on the lifting-table-guide stand 10. All rollers 11, 12 and 13, after realization of the described adjustment procedure, will contact the guide elements 7, 8 with equal adjustment force.

Figure 3:
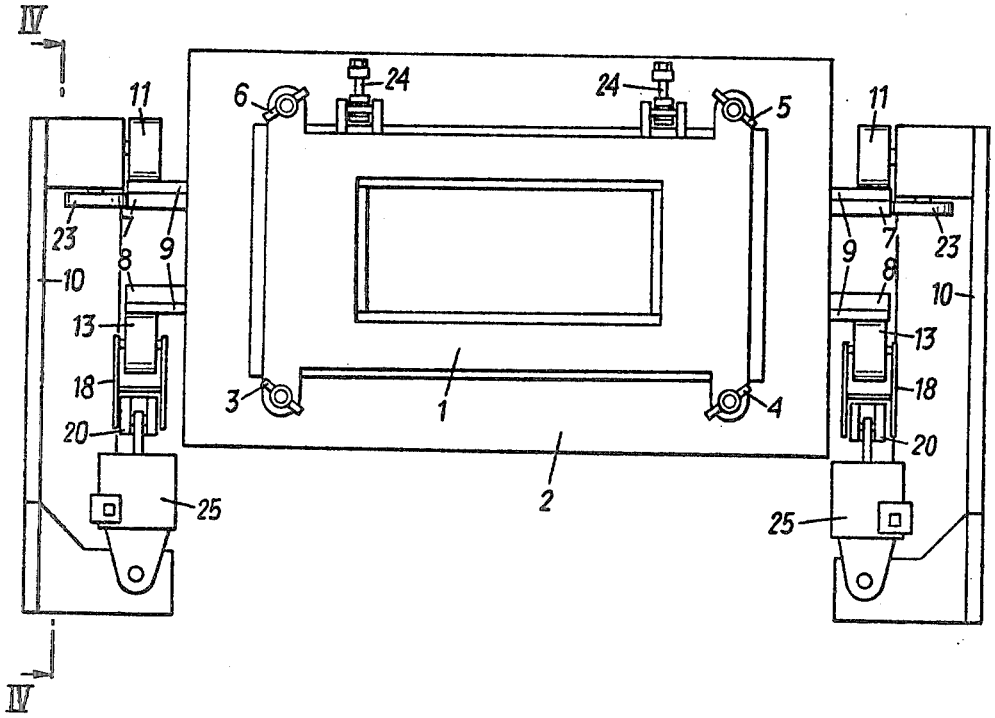
FIGS. 3 and 4 show another embodiment in illustrations analogous to FIGS. 1 and 2.
Figure 4:
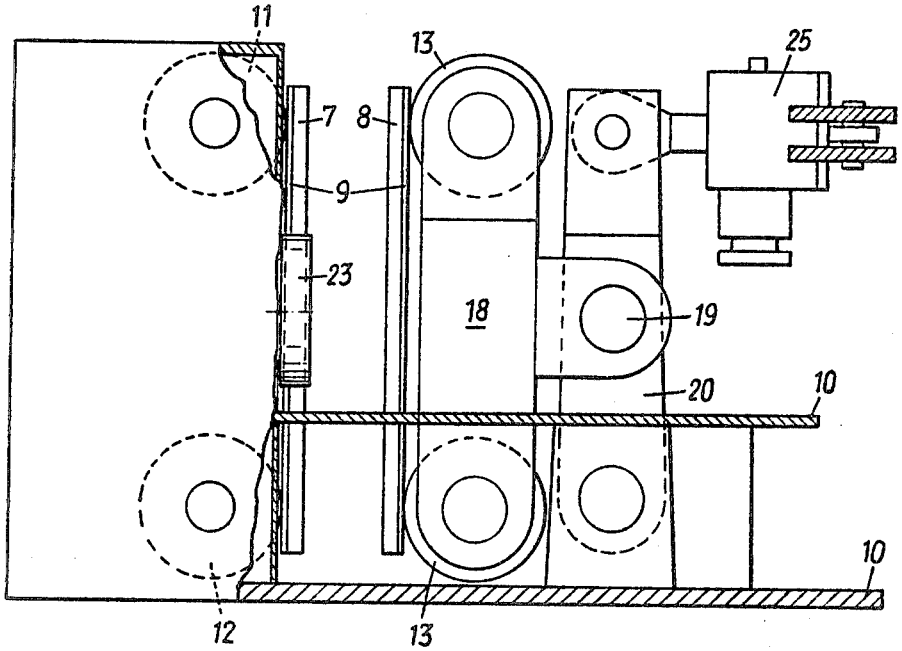

With the embodiment illustrated in FIGS. 3 and 4, the mould 1 is adjustably mounted relative to the lifting-table 2 by means of adjusting spindles 24, so that a separate adjustment mechanism for the rollers 11 and 12 is not necessary. Instead of the turnbuckle 22, a hydraulic gear 25 is provided in this embodiment.

What we claim is:

1. In a lifting-table-guide arrangement of a continuous casting plant, of the type including a mould lifting-table, a stand for guiding said mould lifting-table, a first and a second pair of vertical guide elements arranged opposite each other on opposing sides of said mould lifting-table, two pairs of rollers mounted on said opposing sides the rollers of each pair being positioned one above the other in said stand for supporting one element of the first pair of vertical guide elements, and a pair of counter bearing means provided on said opposing sides supporting the second pair of vertical guide elements, the improvement wherein each said counter bearing means comprises a rocker, two further rollers mounted in said rocker at a distance from each other for supporting one element of the second pair of vertical guide elements, and a bearing provided for mounting said rocker on said stand.

2. A lifting-table-guide arrangement as set forth in claim 1, further comprising a stationary pivot axis, a lever arranged so as to be pivotable and fixable about said stationary pivot axis, said counter bearing being arranged on said lever, and a displacement mechanism for displacing said lever, said displacement mechanism being hinged, on the one hand, to said lever at a distance from said bearing of said rocker, and, on the other hand, to said stand.

3. A lifting-table-guide arrangement as set forth in claim 2, wherein said displacement mechanism is a turnbuckle.

4. A lifting-table-guide arrangement as set forth in claim 2, wherein said displacement mechanism is a hydraulic gear.

* * * * *